United States Patent [19]

Smirne

[11] 4,378,065

[45] Mar. 29, 1983

[54] STAPLE MAGAZINE HOLDER

[76] Inventor: Frank S. Smirne, 1240 Washington St., Whitehall, Pa. 18052

[21] Appl. No.: 377,459

[22] Filed: May 12, 1982

[51] Int. Cl.[3] ..... B65D 69/00

[52] U.S. Cl. ..... 206/230; 206/341; 206/347; 221/70

[58] Field of Search ..... 206/341–343, 206/345, 346, 347, 334, 230, 442, 238, 338; 221/70, 71, 74, 72, 307, 310; 227/95, 110; 29/413

[56] References Cited

U.S. PATENT DOCUMENTS

| | | | |
|---|---|---|---|
| 2,009,580 | 7/1935 | Gouanus | 227/136 |
| 2,127,665 | 8/1938 | Leslie | 29/413 |
| 2,637,030 | 5/1953 | Wickman et al. | 227/120 |
| 3,080,564 | 3/1963 | Strekopitov et al. | 206/340 |
| 3,165,968 | 1/1965 | Anstett | 206/343 |
| 3,238,983 | 3/1966 | Abrahamsen | 227/120 |
| 3,846,900 | 11/1974 | Weglage | 29/413 |
| 3,883,064 | 5/1975 | Hilgers | 227/120 |
| 4,326,661 | 4/1982 | Maurer et al. | 227/120 |

*Primary Examiner*—Joseph Man-Fu Moy
*Assistant Examiner*—David Fidei
*Attorney, Agent, or Firm*—William B. Noll

[57] ABSTRACT

This invention relates to a portable, hand-operated, staple magazine holder for supplying staples to a work location. The staple magazine holder comprises in combination, an elongated housing having a slot for slidably receiving a plastic strip containing a plurality of staples of a predetermined height, and an extension from said housing through which said staples pass upon exiting from said housing. The extension has a vertical dimension less than said predetermined height such that the staples, contained in and moved by said plastic strip, will project above and below said extension. Additionally, the staple magazine holder includes means for indexing the movement of the staples, and for loading the holder with staples. To operate the staple magazine holder, the user moves the staple containing strip a predetermined distance to expose a staple in said extension. In this position the staple may be anchored in a post by striking the crown portion of the staple.

6 Claims, 9 Drawing Figures

STAPLE MAGAZINE HOLDER

BACKGROUND OF THE INVENTION

The present invention relates to a staple magazine holder in combination with a slide feed strip for receiving a plurality of staples, where said strip is slidably engaged with said holder.

While these specifications may suggest a variety of applications for using the apparatus hereof, the present invention was developed for use by utility linemen who must operate under such restraints as (1) being suspended from a pole, (2) having limited mobility, (3) working under adverse weather conditions, and (4) wearing gloves. These restraints, when coupled with the fact that such linemen must handle large, sharply pointed staples, present a most challenging task.

What may appear to some as a simple means to overcome such a task, namely a pneumatic type stapling device, must remember what goes up the pole must be carried or handled by the linemen. Thus, excess weight or bulk adds another potential limitation to the linemen's task. The present invention greatly simplifies this task by providing a safe, light-weight, portable staple magazine holder with staples.

The prior art, as represented by the patents to Leslie (U.S. Pat. No. 2,127,665), Smith (U.S. Pat. No. 2,771,619) and Anstett (U.S. Pat. No. 3,294,303), teaches several different approaches for providing means for supplying staples, or other type of fasteners, to a work location. However, none of these approaches are suitable for handling large staples, on the order of 1½ inches high or larger, while at the same time protecting the linemen from exposure to the sharp ends of the staples during handling and use of the holder. The manner by which this is accomplished will be detailed in the specifications which follow.

SUMMARY OF THE INVENTION

This invention is directed to a portable, hand-operated, staple magazine holder, such as may be used by electric power linemen, for supplying staples to a work location where the staples may be sequentially driven into a pole or post by the user thereof. The staple magazine holder comprises in combination, an elongated housing having a slot for slidably receiving a plastic strip containing a plurality of staples of a predetermined height, and an extension from said housing through which said staples pass upon exiting from said housing. The extension has a vertical dimension less than said predetermined height such that the staples, contained in and moved by said plastic strip, will project above and below said extension. Additionally, means are provided for the incremental movement of staples through the holder extension, and for loading staples in said plastic strip.

In operation, the user, i.e. lineman, moves the staple-containing strip a predetermined distance to expose a staple in said extension. When such staple is positioned the lineman strikes a hammer to the staple crown, driving the staple into a pole thereby anchoring the staple. With the staple anchored, the holder may be pivoted about such anchored staple thereby releasing the staple from the grip of the plastic strip. Once the staple is free from the holder the staple may be struck again driving the staple further into the pole.

DETAILED DESCRIPTION OF THE PREFERRED EMBODIMENT

Figure 8:
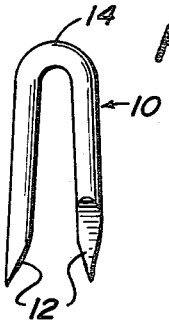
FIG. 8 is a side elevational view of a typical staple used herein.

The present invention is directed to a portable, hand-operated staple magazine holder, particularly for use in applications where large, sharply pointed staples are required. Such a staple (full size) is illustrated in FIG. 8. The staple 10 is provided with a pair of spaced, non-parallel legs 12 joined together by a crown portion 14. The staples, typically formed of metal plated and/or chemically treated steel, are driven into a receiving pole by the application of force, such as by a hammer, to the crown portion 14.

Figure 1:
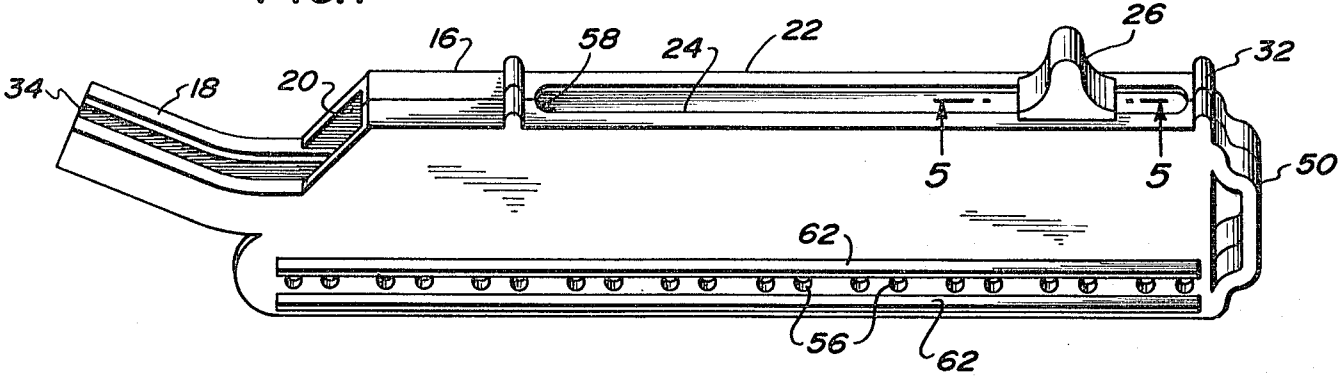
FIG. 1 is a perspective view of a staple magazine holder according to the present invention.
Figure 2:
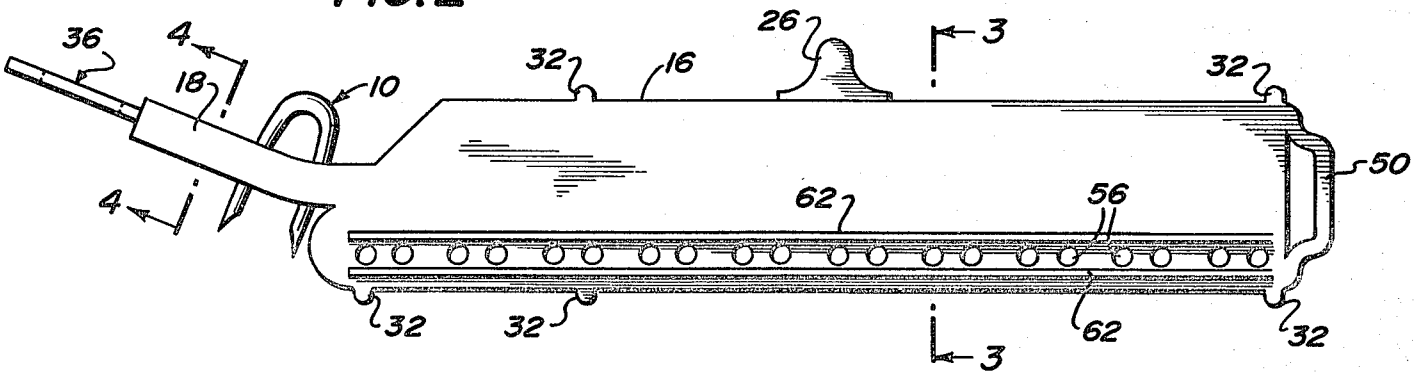
FIG. 2 is a side elevational view of the staple magazine holder of FIG. 1, showing, however, said holder in an operative position.

By virtue of the staple size and the potential of such staples to injure through improper use thereof, the present invention was developed to provide a safe and efficient means for handling large staples. Such means is illustrated in FIGS. 1 and 2.

The staple magazine holder of this invention comprises a housing 16 having an extension 18 projecting therefrom, preferably at an angle of about 22° from the horizontal. The housing 16 is provided with opening 20 at one end thereof through which the staples 10 move. Additionally, housing 16, along the top surface 22, is provided with a slot 24 along which slide member 26 moves to sequentially advance the staples 10 through opening 20 into extension 18. The manner by which such movement is accomplished will become more evident hereinafter.

Figure 3:
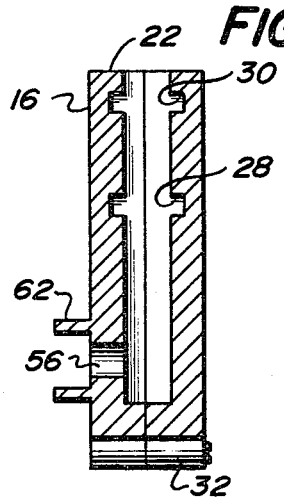
FIG. 3 is a sectional view taken along line 3—3 of FIG. 2.

Internally, housing 16 is provided with a first channel 28 along which the staples 10 are moved, see FIG. 3. A second channel 30 is located near top surface 22 for slidably receiving slide 26. For weight saving purposes, the housing 16, including extension 18, may be formed by injection molding mating halves and securing them together by suitable and well known means, such as fasteners through mating holes in flanges 32.

The extension 18 is of such a size, i.e. vertical dimension, that the staples project above and below the top and bottom thereof. Said extension is provided with a single channel 34 which is a continuation of channel 28 so as to permit the smooth and uninterrupted movement of the staples from within housing 16 into extension 18.

Figure 7:
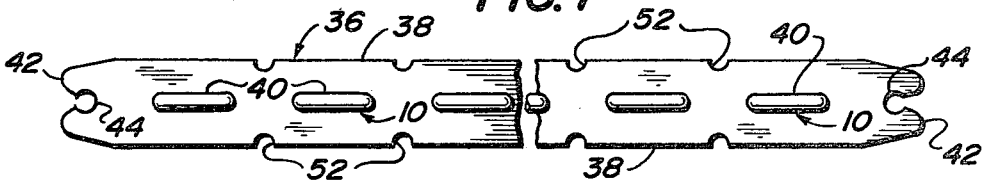
FIG. 7 is a perspective view of a channel member used for positioning the staples prior to inserting such staples in the staple magazine holder.

The staples 10 are arranged side by side in a plastic strip 36. FIG. 7 illustrates the staple holding strip 36, such as nylon. Such strip, in its preferred embodiment, may be constructed by Rilsan Nylon 11, manufactured by Rilsan Corp. of Glen Rock, N.J. Rilsan Nylon 11 is characterized by good memory and strength, two desirable features for repeated use. In any case, strip 36 is characterized by parallel sides 38 and a width so as to freely move along channel 28. Interiorly of the strip 36 are a plurality of axially aligned slots 40, each of which is dimensioned to snugly receive a staple 10. As noted previously, the staples are characterized by nonparallel legs, that is, essentially V-shaped in configuration. The staples are secured in the strip by inserting the crown portion 14 through the slot 40 to a predetermined depth. Such depth of penetration is reached when an interference fit is achieved. That is, the nylon strip 36 begins to yield thereby applying a constraining pressure to the contained staple. By means to be described hereinafter, a system is disclosed for engaging the strip 36 and staples 10 in the desired predetermined relationship.

Figure 6:
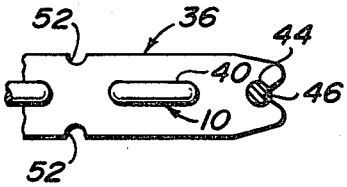
FIG. 6 is a sectional view taken along line 6—6 of FIG. 5.

The strip 36, at each end 42, may be provided with a through slot 44 to receive slide extension 46. The slide extension is configured (see FIG. 6) so as to be locked into slot 44. Thus, movement of slide member 26, which in turn is securely fastened to slide extension 46, will cause the staples to move a distance equal to that of the movement of the slide member 26.

MODIFICATIONS

1. For convenience in carrying the staple magazine holder of this invention, loop 50, fixed to housing 16, may be provided. By means well known in the art, the loop 50 may be attached to a clamp, for example, suspended from the belt of the user thereof.

Figure 4:
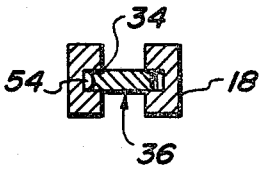
FIG. 4 is a sectional view taken along line 4—4 of FIG. 2.
Figure 5:
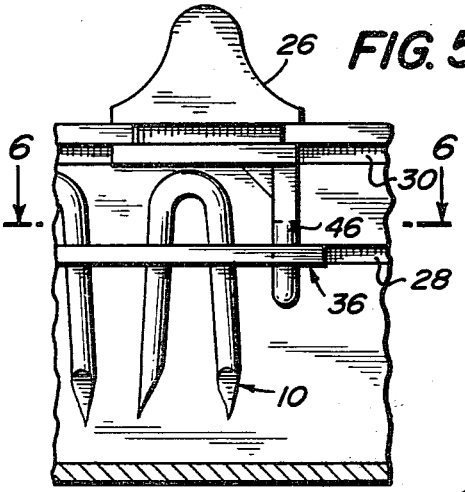
FIG. 5 is a sectional view taken along line 5—5 of FIG. 1.

2. To assist the user of this staple magazine holder in positioning a particular staple within the extension 18, means have been provided to index the plastic staple strip 36. FIG. 7 illustrates a preferred indexing system for this invention. Along the parallel sides 38 there are provided a plurality of register locations 52 in the form of slots, preferably one for each staple slot. In operation such slots align and mate with a nipple 54 located in the staple channel in extension 18, see FIG. 4. The alignment of such slots with nipple 54 provides sufficient stability to the user thereof to locate the staples for subsequent hammering. However, by virtue of the flexibility of the plastic strip, its movement along channel 28 is not seriously impaired. That is, only a minimum of effort is required to disengage the aligned slot and nipple for realignment of such nipple with the adjacent slot.

Figure 9:
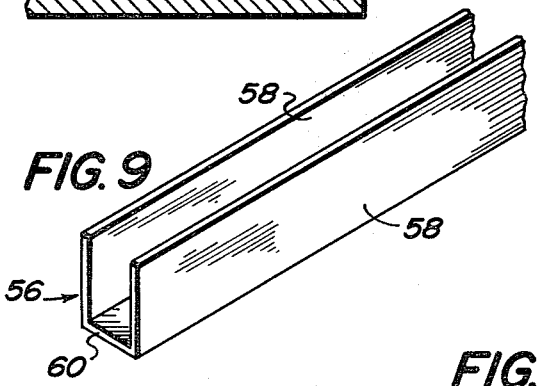
FIG. 9 is a top plan view of the staple holding strip.

3. Since the large and sharply pointed staples contemplated for use by this invention represent a source of danger to the user from cutting, a system has been devised for loading the staple strip 36. Along the side of housing 16, a plurality of holes 54, aligned between ribs 62, are provided to receive staple legs 12. To use such system, staples are arranged in side by side relationship in holes 54. Next, the plastic strip 36 is placed over the staples such that the crown portions 14 project through the strip slots 40. To press fit the staples to a predetermined depth within the slots 40, a U-shaped channel 56 (illustrated in FIG. 9) is placed over the aligned staples and strip 36 to push said strip down upon the staples. The plastic strip 36 yields sufficiently to provide a gripping action on the contained staples.

The channel legs 58 are of such a depth that when the staple crown portion 14 contacts channel base 60, the staples are uniformly arranged within the strip 36 and ready for insertion into the housing 16. In such prearranged position, the staples project above and below the strip an equal distance. Finally, the channel 56, for convenience, may be stored in the housing 16 by inserting the channel 56 through an opening below the extension 18.

4. In the preferred embodiment illustrated in FIG. 2, the extension 18 projects from housing 16 at an angle. While the angle may vary from 15° to 30°, a preferred angle is about 22° from the horizontal. It was discovered that by angling the extension in the manner illustrated, better leverage, when the housing 16 is pushed against the staple-receiving pole, was achieved in releasing the staples from the grip of strip 36.

OPERATION AND SPECIFIC EMBODIMENT

Ten $1\frac{1}{2}$ inch staples, having lateral dimensions of 0.610 inches (mid-point) and 0.580 (below crown) are arranged side by side in holes 54. Next, strip 36, made of Rilsan Nylon 11, is placed over the arranged staples such that slots 40 are aligned with the crown portions 12 of the staples. To secure such staples in proper relationship with strip 36, channel member 56 is inverted and placed over the staples. The channel member 56 is pressed against the strip 36 pushing the strip uniformly down upon the staples to the desired predetermined depth along the staples. The strip slots 40 have a longitudinal dimension slightly less than 0.610 inches such that when the strip 36 is pressed down on the staples the slots 40 yield to squeeze each contained staple.

The strip 36, with staples securely in place, is placed in the housing 16 by sliding such strip into channel 34 and hence into channel 28. When the strip end 42 contacts slide extension 46 the slot 44 engages therewith such that movement of slide member 26 will move the strip 36.

The staple magazine holder of this invention is now ready for use. The slide member 26, as viewed in FIG. 2 for example, is moved toward the left so as to engage a first slot 52 with nipple 54 and position an exposed staple within the extension 18. In such position, the exposed staple may be placed over a wire or cable to be anchored to a pole, and a hammer struck against the crown portion of the staple driving the sharpened ends of the staple into said pole. With the driven staple anchored in the pole, the staple magazine holder may be moved, for example, through the use of leverage by pivoting about the staple, thereby releasing such staple from the grip of strip 36. In similar fashion the next staple may be positioned for use.

When the slide member 26 reaches end 58 of slot 24, the staple strip 36, still containing several staples, typically one-half of the original ten, may be reversed and reinserted into housing 16. By this arrangement all of the staples contained within the housing 16 may be safely brought to the work location as needed.

I claim:

1. A staple magazine holder comprising in combination, (1) an elongated housing having a slot for slidably receiving a plastic strip containing a plurality of staples of a predetermined height, and an extension from said housing through which said staples pass upon exiting from said housing, said extension having a vertical dimension less than said predetermined height whereby such staples project above and below said extension, (2) a plastic strip having parallel sides for engagement with said slot, and a plurality of spaced apart openings, where each opening is adapted to receive a single staple, and (3) means for moving said plastic strip along said slot.

2. The staple magazine holder according to claim 1 wherein said extension is angled.

3. The staple magazine holder according to any one of claims 1 and 2 including means for indexing the movement of said strip into said extension.

4. The staple magazine holder according to claim 3 wherein said indexing means comprises a plurality of spaced apart locations along said parallel sides, which locations are adapted to register with a predetermined position in said extension.

5. The staple magazine holder according to any one of claims 1 and 2 wherein said means for moving said strip includes a slide member engageable with said strip.

6. The staple magazine holder according to claim 5 including means to prealign a plurality of staples and to position such staples in a predetermined relationship with a second strip for insertion into said elongated housing.

* * * * *